US005358380A

United States Patent [19]

Arakawa

[11] Patent Number: 5,358,380

[45] Date of Patent: Oct. 25, 1994

[54] PUMP CASING MADE OF SHEET METAL

[75] Inventor: Shinichiro Arakawa, Tokyo, Japan

[73] Assignee: Ebara Corporation, Tokyo, Japan

[21] Appl. No.: 123,673

[22] Filed: Sep. 20, 1993

Related U.S. Application Data

[63] Continuation of Ser. No. 819,881, Jan. 13, 1992.

[30] Foreign Application Priority Data

Jan. 11, 1991 [JP] Japan ..... 3-12700
Mar. 12, 1991 [JP] Japan ..... 3-13894

[51] Int. Cl.[5] ..... F04D 29/42

[52] U.S. Cl. ..... 415/200; 415/204; 415/206; 415/207; 415/213.1; 415/214.1; 415/215.1

[58] Field of Search ..... 415/182.1, 200, 203, 415/204, 206, 207, 212.1, 213.1, 214.1, 215.1

[56] References Cited

U.S. PATENT DOCUMENTS 3,190,226 6/1965 Judd ..... 415/206
3,717,045 2/1973 Burenga ..... 415/204
4,775,295 10/1988 Starke et al. .
5,040,947 8/1991 Kajiwara et al. .
5,069,599 12/1991 Carretta .
5,112,190 5/1992 Kajiwara et al. .
5,133,642 7/1992 Kajiwara .
5,184,937 2/1993 Arakawa et al. .

FOREIGN PATENT DOCUMENTS 0442070 8/1991 European Pat. Off. .
3517828 11/1986 Fed. Rep. of Germany .
3717827 11/1986 Fed. Rep. of Germany .
3517498 6/1987 Fed. Rep. of Germany .
62-195496 8/1987 Japan .
3-54398 3/1991 Japan .
0027800 1/1908 Sweden ..... 415/182.1

*Primary Examiner*—Edward K. Look
*Assistant Examiner*—Christopher Verdier
*Attorney, Agent, or Firm*—Wenderoth, Lind & Ponack

[57] ABSTRACT

A pump casing made of sheet metal comprises a casing jacket having a cylindrical cup shape, an end plate formed at one side of the casing jacket, a casing flange formed at the other side of the casing jacket and a projecting portion radially outwardly bulged so as to have a volute shape. The end plate is axially outwardly bulged so as to have an arcuately curved surface, and the base portion of the projecting portion is located on the extension of the arcuately curved surface of the end plate so as to provide continuity from the end plate to the projecting portion. With the above structure, there is no portion where a great deal of bending stress caused by stress concentration is generated, and the pump casing has a sufficient strength and rigidity against not only piping forces but also internal pressure.

2 Claims, 9 Drawing Sheets

PUMP CASING MADE OF SHEET METAL

This is a continuation application of Ser. No. 07/819,881, filed Jan. 13, 1992.

BACKGROUND OF THE INVENTION

The present invention relates to a pump casing made of sheet metal, and more particularly to a pump casing made of sheet metal which has a sufficient strength and rigidity against external forces such as piping forces which are applied to a suction flange and an outlet flange provided on the pump casing.

Conventionally, there is known a pump casing made of sheet metal in which a casing jacket is formed of sheet metal such as a stainless steel and manufactured by press work. As shown in FIG. 13(*a*) and (*b*), this type of pump casing is provided with a suction nozzle 4 having an end to which a suction flange 14 is integrally attached. The pump casing also includes an outlet nozzle 22 having an end to which an outlet flange 23 is integrally attached. Further, the pump casing is integrally formed, at the side of a motor, with a casing flange 2 which is attached to a bracket 5 made of castings. A casing jacket cover 12 is attached to the casing flange 2 in such a manner that the outer periphery of the casing jacket cover 12 is engaged with the casing flange 2 and fixed to the casing flange 2. An impeller 8 is housed in the inside of the casing jacket 1 and the casing Jacket cover 12, and is supported by the end of a shaft 10 connected to a motor M. A shaft seal 11 such as a mechanical seal is provided between the casing jacket cover 12 and the shaft 10 to seal off the clearance therebetween. The casing jacket 1 is fixedly mounted on a base 24 through a leg member 13.

The above conventional pump casing is formed of a relatively thin plate because it is restricted by the characteristics of press work and by manufacturing costs. Therefore, not only an internal pressure generated by the pump per se but also external forces such as piping forces are applied to the pump casing, thus causing the pump casing to be deformed.

Therefore, conventionally, as shown in FIGS. 13(*a*) and 13(*b*), in order to cope with the piping forces applied to the suction flange, supporting members 19 are provided between the suction flange 14 and the casing jacket 1. Although the piping forces are transmitted to the casing jacket 1 through the supporting members 19, the casing jacket 1 inherently does not have a sufficient strength to bear the piping forces. As a result, the casing jacket 1 is deformed, the liner portion 1L integrally provided on the casing jacket 1 may be slightly brought into contact with an end portion 8*a* of an impeller 8. This slight contact generates noise and causes overload. It further tends to lead to closer contact of both members (the liner ring portion 1L and the end portion 8*a* of the impeller 8) which causes unexpected trouble such as damage to the impeller.

On the other hand, in order to cope with the piping forces applied to the outlet flange 23, similar supporting members 40 are provided between the outlet flange 23 and the casing jacket 1. However, as mentioned above, the casing jacket 1 does not have a sufficient strength to bear the piping forces.

Further, as shown in FIG. 13(*b*), since the end plate 7 is axially inwardly curved, the end plate 7 is deformed by internal pressure to thereby bulge axially outwardly. Thus, a great deal of bending stress is generated at the connecting portion of the casing cylindrical portion and the end plate 7. In the type of casing having a projecting portion radially outwardly bulged to form a volute shape, in general, since a bent portion is formed at the connecting portion of the casing cylindrical portion and the projecting portion, a great deal of bending stress is generated by the internal pressure at the bent portion. That is, the conventional casing does not have sufficient strength to withstand the piping forces as well as the internal pressure.

SUMMARY OF THE INVENTION

It is therefore an object of the present invention to provide a pump casing made of sheet metal which has strength and rigidity sufficient to withstand not only piping forces but also internal pressure.

Another object of the present invention is to provide a pump casing made of sheet metal in which, even if excess external forces such as piping forces are applied to the suction flange, deformation of the liner ring portion of the casing can be prevented or can be reduced to a minimum, thereby preventing the liner ring portion from contacting the impeller.

Still another object of the present invention is to provide a pump casing made of sheet metal having a casing supporting member which has a simple structure and great supporting ability, and which has the function of not transmitting the piping forces to the casing jacket.

In order to achieve the above objects, according to a first aspect of the present invention, there is provided a pump casing made of sheet metal and comprising: a casing jacket having a cylindrical cup shape; an end plate formed at one side of the casing jacket, the end plate being axially outwardly bulged so as to have an arcuately curved surface; a casing flange formed at the other side of the casing jacket; and a projecting portion radially outwardly bulged so as to have a volute shape, the base portion of the projecting portion being located on the extension of the arcuately curved surface of the end plate so as to provide continuity from the end plate to the projecting portion.

With the above structure, since the projecting portion is bulged outwardly in a predetermined manner, the end plate has an arcuately curved surface, the base portion of the projecting portion is located on the extension of the arcuately curved surface of the end plate so as to provide continuity from the end plate to the projecting portion, there is no portion where a great deal of bending stress caused by stress concentration is generated, and the pump casing has sufficient strength and rigidity to withstand not only piping forces but also internal pressure in its entirety.

According to a second aspect of the present invention, there is provided a pump casing made of sheet metal and comprising: a casing jacket having a cylindrical cup shape; an end plate formed at one side of the casing jacket, the end plate being axially outwardly bulged so as to have an arcuately curved surface; a casing flange formed at the other side of the casing jacket; a projecting portion radially outwardly bulged so as to have a volute shape; a suction flange connected to the end plate; an outlet flange connected to the casing jacket; and a casing supporting member having a substantially U-shaped cross section and three supporting surfaces, the casing flange, the suction flange and the outlet flange being mounted on the three supporting surfaces, respectively.

With the above structure, even if excess external forces such as piping forces are applied to the suction flange, deformation of the liner ring portion can be prevented or can be reduced to a minimum, thereby preventing the liner ring or the liner ring member from contacting the impeller because the external forces are transmitted to the end plate of the casing jacket having a rigid structure through the suction flange supporting member. Further, the liner ring portion is provided on the inner casing independently of the end plate or the suction nozzle so that the external forces are not directly transmitted to the liner ring member.

According to a third aspect of the present invention, a pump casing is made of sheet metal comprises: a casing jacket having a cylindrical cup shape; an end plate formed at one side of the casing jacket, the end plate being axially outwardly bulged so as to have an arcuately curved surface; a casing flange formed at the other side of the casing jacket; a projecting portion radially outwardly bulged so as to have a volute shape; a suction flange connected to the end plate; an outlet flange connected to the casing jacket; and a casing supporting member having a substantially U-shaped cross section and three supporting surfaces, the casing flange, the suction flange and the outlet flange being mounted on the three supporting surfaces, respectively.

With the above structure, the piping forces applied to the suction flange are partially transmitted to the outlet flange through the casing supporting member, then to the casing flange having the highest rigidity through the casing supporting member. In general, the casing flange is mounted on the bracket made of castings, therefore this part has the highest rigidity in the pump casing. The piping forces applied to the outlet flange are mainly transmitted to the casing flange having the highest rigidity through the casing supporting member. Therefore, the pump casing is prevented from being deformed due to the piping forces.

According to a fourth aspect of the present invention, there is provided a pump casing made of sheet metal and comprising: a casing jacket having a cylindrical cup shape; an end plate formed at one side of the casing jacket; a casing flange formed at the other side of the casing jacket; a suction flange connected to the end plate; an outlet flange connected to the casing jacket; and a casing supporting member being in the form of channel and having four supporting surfaces, the casing flange, the suction flange and the outlet flange being mounted on three supporting surfaces of the four supporting surfaces, respectively, the remaining one supporting surface serving as a leg member for supporting the pump casing.

With the above structure, since the casing supporting member has three supporting surfaces on which the casing flange, the suction flange and the outlet flange are mounted, respectively, not only the piping forces applied to the pump casing but also the internal pressure applied thereto are borne by the casing supporting member, and the pump casing is prevented from being deformed. The remaining supporting surface of the casing supporting member is utilized as a leg member for supporting the pump casing.

Since the casing supporting member has four supporting surfaces which are fixed to the casing flange, the suction flange, the outlet flange and the base, respectively, the strength of the casing supporting member is enhanced more than the strength of the casing supporting member per se. As a result, external forces F such as piping forces which are applied to the suction pipe and the outlet pipe as bending moments and axial external forces W are borne by the casing supporting member. Therefore, these forces are not transmitted to the pump casing. Accordingly, the pump casing is prevented from being deformed.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE INVENTION

An embodiment of a pump casing made of sheet metal according to the present invention will be described below with reference to FIGS. 1 through 8.

Figure 1:
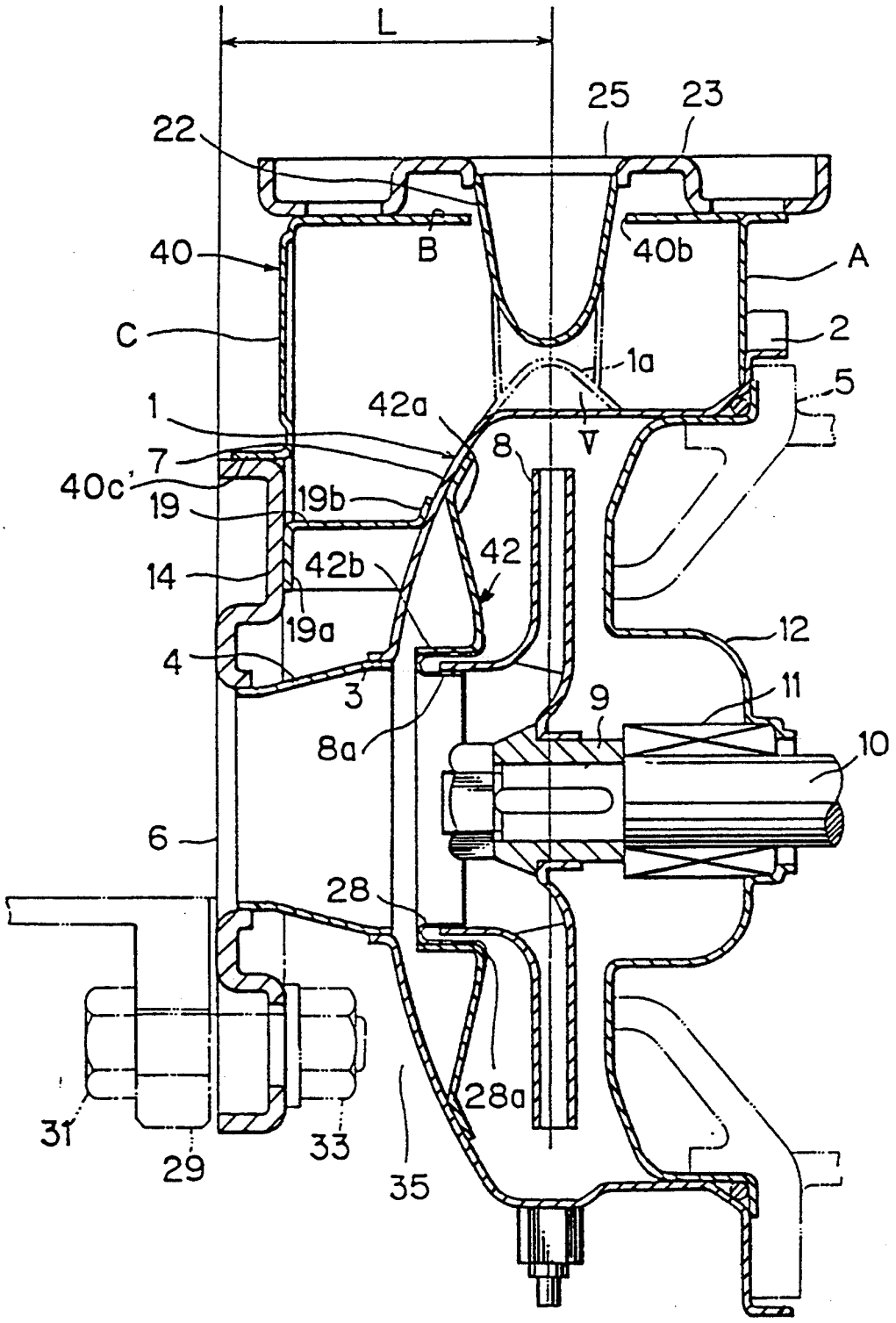
FIG. 1 is a cross-sectional view showing the centrifugal pump, with the section being taken along line I—I of FIG. 3.

FIG. 1 is a cross-sectional view showing a centrifugal pump incorporating a pump casing of the present invention.

Referring first to FIG. 1, the centrifugal pump has a casing jacket 1 which is formed of a metal sheet such as a steel plate and is manufactured by deep drawing press work. The casing jacket 1 has one end integrally formed with a casing flange 2 which is connected to a bracket 5 of a motor (not shown), and has another end formed with an end plate 7 having an axially bulged shape to enhance the strength of the casing jacket 1. The end plate 7 is formed with a suction side hole 3 at the central portion thereof. A suction nozzle 4 is inserted into the suction side hole 3 and is connected to the end plate 7. A suction flange 14 is fixedly secured to the forward end of the suction nozzle 4. The suction flange 14 has, at a central portion thereof, a suction port 6. The suction nozzle 4 has a slightly tapered cylindrical shape and its cylindrical rear end is inserted into the suction side hole 3 and is welded to the end plate 7 of the casing jacket 1.

The casing jacket 1 has a radially projecting portion 1*a*. A volute chamber V is defined inside the projecting portion 1*a* of the casing jacket 1 and is positioned at a central portion of the casing jacket 1. The end plate 7 has an arcuately curved surface. As shown in FIG. 4, the base portion b of the projecting portion 1*a* is located on the extension of the arcuately curved surface of the end plate 7 so as to provide continuity from the end plate to the projecting portion 1*a*. That is, the curvature of the base portion b of the projecting portion 1*a* is the same as the curvature of the outer periphery of the end plate 7.

Figure 3:
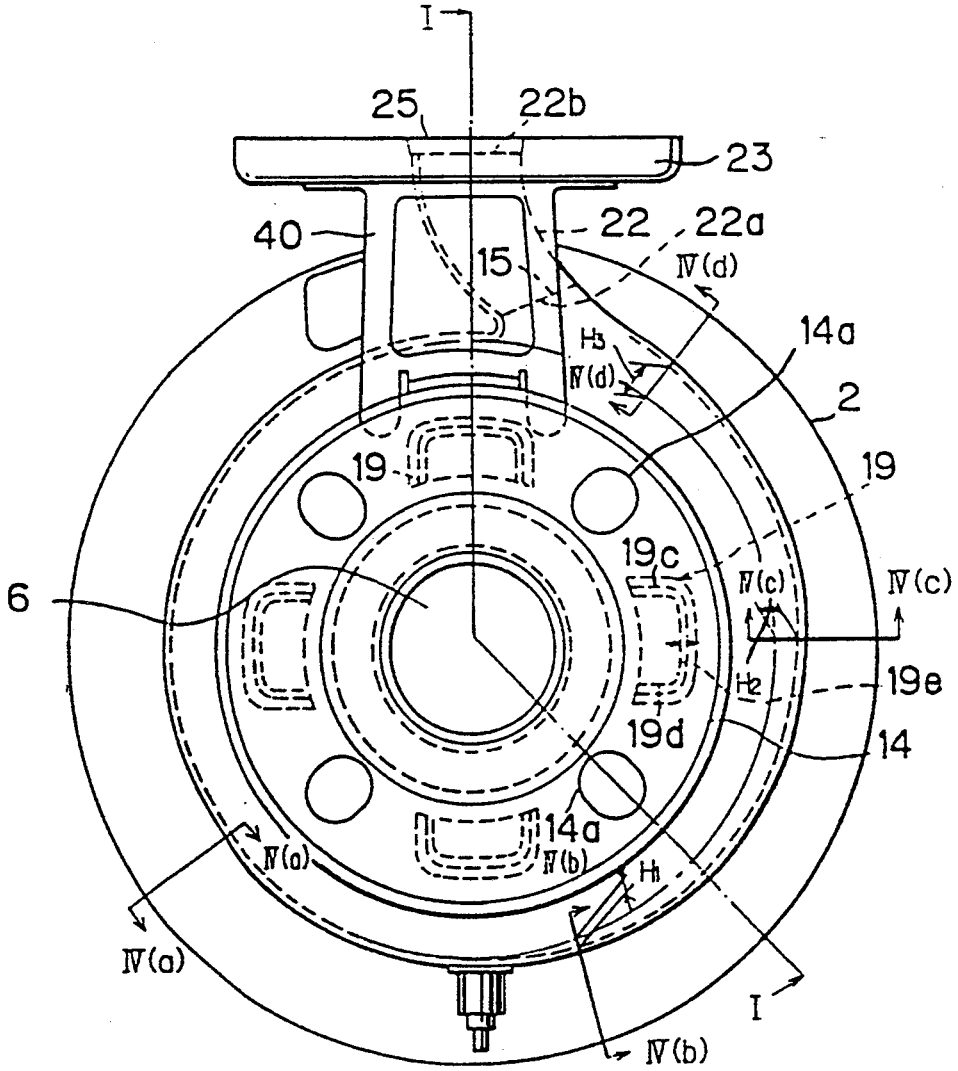
FIG. 3 is a front view showing the centrifugal pump including its casing made of sheet metal according to the embodiment of the present invention.
Figure 4A:
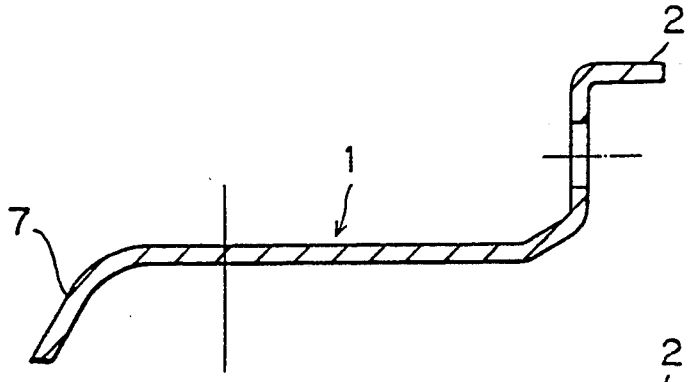
FIGS. 4(*a*) through 4(*d*) are cross-sectional views showing a casing jacket, wherein FIG. 4(*a*) is a section taken along line IV(a)—IV(a) of FIG. 3, FIG. 4(*b*) is a section taken along line IV(b)—IV(b) of FIG. 3, FIG. 4(*c*) is a section taken along line IV(c)—IV(c) of FIG. 3, and FIG. 4(*d*) is a section being taken along line IV(-d)—IV(d) of FIG. 3.
Figure 4B:
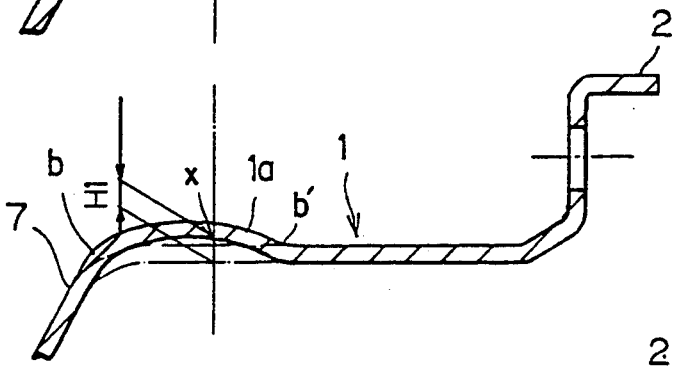
Figure 4C:
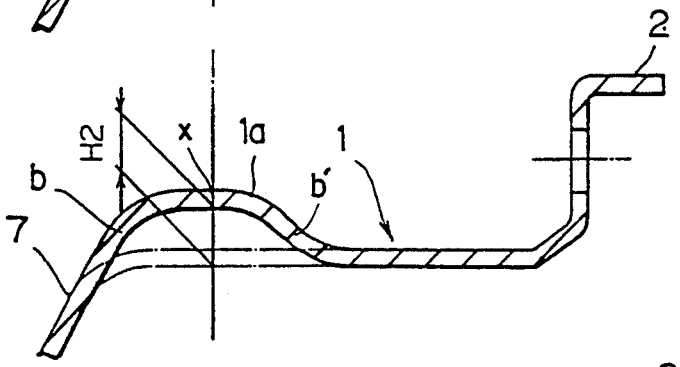
Figure 4D:
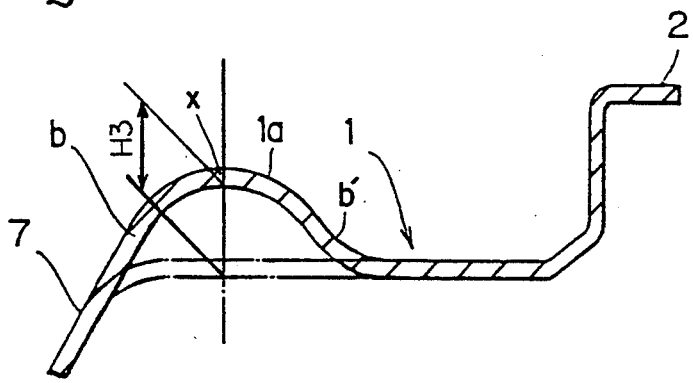

In other words, the projecting portion 1*a* has first and second base portions b and b′ connecting to the casing jacket 1 and a radially outermost portion X between the first and second base portions b and b′. The first base portion b is formed as an extension of the arcuately curved end surface of the end plate 7 such that a major portion of the arcuately formed end surface, together with a first portion extending from the first base portion b to the radially outermost portion X of the projecting portion 1*a*, constitute a continuous portion having no inflection points (i.e. no points at which the curvature in one direction inflects to a curvature in the opposite direction). Therefore there is no portion where a great deal of bending stress caused by stress concentration is generated, and the pump casing has a high rigidity and strength. The projecting height H of the projecting portion 1*a* continuously increases in a circumferential direction as shown in FIG. 3. This can be represented by $H_1<H_2<H_3$ in FIG. 8.

Figure 8A:
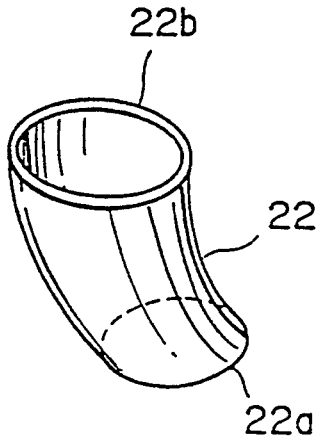
FIG. 8(*a*) and 8(*b*) show the outlet nozzle, FIG. 8(*a*) is a perspective view of the outlet nozzle of FIG. 1, and FIG. 8(*b*) is an end view of the outlet nozzle of FIG. 1.
Figure 8B:
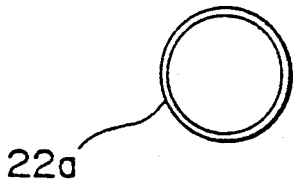

Therefore, the sectional area of fluid passage in the volute chamber V gradually increases in the flow direction of a fluid such as water. Further, an outlet nozzle 22 has one end connected to the terminal portion of the projecting portion 1*a* of the casing jacket 1. The terminal portion of the projecting portion 1*a* has a pressure side hole 15 having a circular cross-section to enable the pump to have a high performance, and the outlet nozzle 22 also has a circular cross-section as shown in FIG. 8 corresponding to the pressure side hole 15 of the projecting portion 1*a*. Another end (outlet) 22*b* of the outlet nozzle 22 is connected to an outlet flange 23 which is formed with an outlet port 25 at the central portion thereof. The diameter of the outlet nozzle 22 gradually increases from the inlet 22*a* towards the outlet 22*b* as shown in FIG. 8.

Further, an impeller 8 is disposed inside the casing jacket 1. The impeller 8 is integrally provided with a boss 9 which is connected to a free end of a shaft 10 through a key. The shaft 10 is rotatably supported by a bearing (not shown). A casing jacket cover 12 is provided at the pressure side of the casing jacket 1. A shaft seal 11 is provided between the casing jacket cover 12 and the shaft 10 to seal off the clearance therebetween.

An inner casing 42 is provided inside the casing jacket 1. To be more specific, the inner casing 42 has a disk portion 42*a* and a cylindrical portion 42*b* constituting a liner ring member at the inner periphery of the disk portion 42*a*. An outer periphery of the disk portion 42*a* is welded to the inside wall of the end plate 7.

Figure 2:
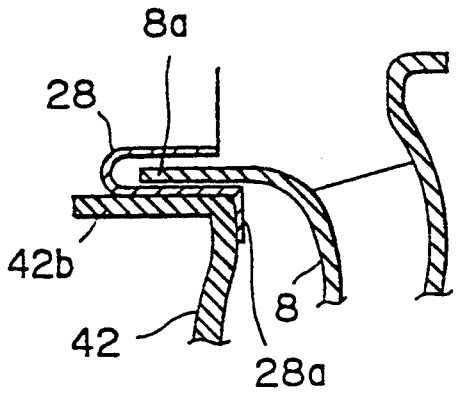
FIG. 2 is a partially enlarged cross-sectional view showing a liner ring and an end of an impeller of the centrifugal pump of FIG. 1.

Between an end portion 8*a* located at the suction side of the impeller 8 and the cylindrical portion 42*b* of the inner casing 42, there is provided a liner ring 28 having an approximately U-shaped section to prevent counterflow in the clearance between the end portion 8*a* of the impeller 8 and the casing jacket 1. The liner ring 28 is inserted into the cylindrical portion 42*b* of the inner casing 42 in such a manner that a collar 28*a* of the liner ring 28 abuts against the shoulder of the cylindrical portion 42*b*. A small clearance is provided between the end portion 8*a* of the impeller 8 and the inside surfaces of the liner ring 28 as shown in FIG. 2.

Next, operation of the centrifugal pump will be described briefly.

When the impeller 8 is rotated, fluid is pumped from the suction port 6 into the casing jacket 1 and flows through the impeller 8. The fluid passing through the impeller 8 flows into the volute chamber A having a gradually increased sectional area of fluid passage. Thereafter the fluid is discharged out of the outlet port 25 of outlet flange 23 through the outlet nozzle 22.

Since the casing jacket 1, the suction nozzle 4 and other components of the pump are made of a thin steel plate, external forces such as great piping forces applied to the suction flange 14 may deform the suction flange 14 or the suction nozzle 4 or the like. As a result, the impeller 8 and the liner ring 28 may contact each other. In order to avoid such deformation, in this embodiment, there are provided four supporting members 19 between the suction flange 14 and the end plate 7 of the casing jacket 1 to provide reinforcement for the suction flange 14 and the suction nozzle 4.

The external forces applied to the suction flange 14 are transmitted to the end plate 7 through the supporting members 19. The four supporting members 19 are circumferentially spaced with angular intervals of 90°.

As shown in FIG. 3, each supporting member 19 is formed into an approximately U-shaped section from a steel plate having a thickness of t. The supporting member 19, as is apparent from FIG. 1, has two end portions 19*a*, 19*b* bent in opposite directions. One end portion 19*a* of the supporting member 19 has a flat surface corresponding to a backside surface of the suction flange 14 and is fixedly secured to the backside surface of the suction flange 14. The other end portion 19*b* has a curved surface corresponding to a curved surface of the end plate 7 and is fixedly secured thereto. Further, the U-shaped section of the supporting member 19 includes two rectangular sections 19*c*, 19*d* and a slightly curved section 19*e*, and the supporting member is disposed such that the rectangular sections 19*c*, 19*d* are parallel to a radial line extending through the center of the slightly curved section 19*e*.

Figure 5:
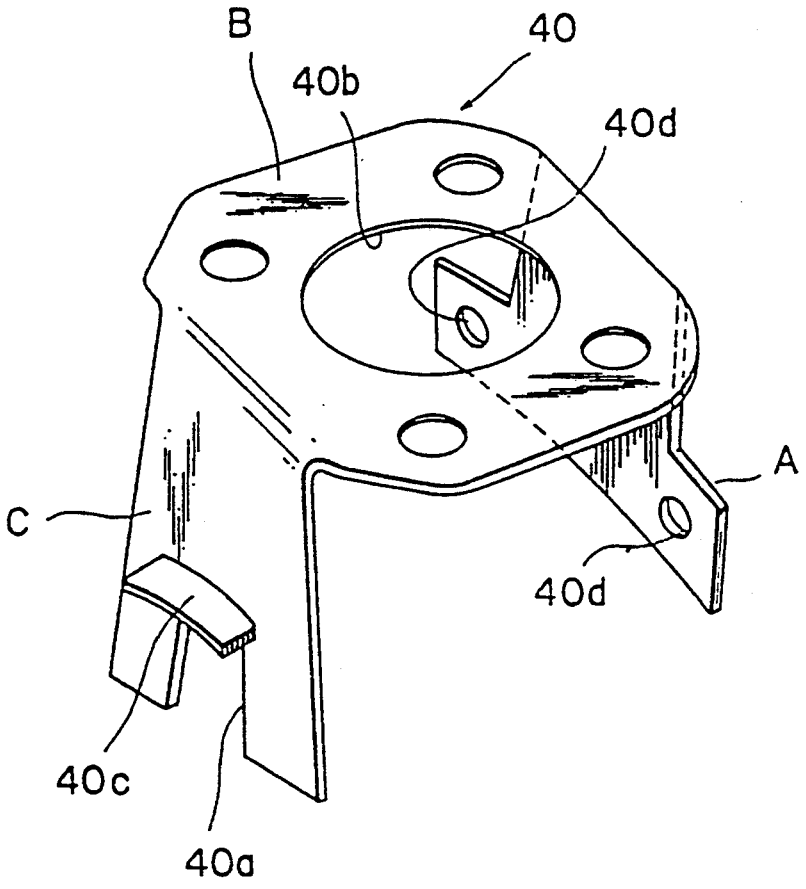
FIG. 5 is a perspective view showing a pump casing supporting member in the pump casing made of sheet metal according to the embodiment of the present invention.

Further, in this embodiment, as shown in FIG. 5, there is provided a casing supporting member 40 having an approximately U-shaped cross section and three supporting surfaces. That is, the casing supporting member 40 has three integral supporting surfaces A, B and C. The supporting surface C corresponding to the front surface (on the left-hand side of FIG. 5) is formed with a cut-away portion 40*a* through which the suction nozzle 4 passes, and the supporting surface B corresponding to the upper surface is formed with an opening 40*b* through which the outlet nozzle 22 passes. The supporting surface A is formed with through holes 40d through which a bolt for fixing the casing jacket cover 12 passes. As shown in FIG. 5, the supporting surface C supports the suction flange 14 mounted thereon by welding or the like and the supporting surface B supports the outlet flange 23 mounted thereon. The supporting surface A supports the casing flange 2 mounted thereon. The casing flange 2 is mounted on the bracket 5 made of castings. The supporting surface C is formed with a portion 40*c* which is connected to the outer periphery of the suction flange 14. Therefore, the piping forces are partly transmitted to the end plate 7 through the supporting members 19, and partly transmitted to the outlet flange 23 through the supporting surface C and then to the casing flange 2 through the supporting surface A of the casing supporting member 40.

On the other hand, the piping forces applied to the outlet flange 23 are partly transmitted to the suction flange 14 through the supporting surface C, but mainly transmitted to The casing flange 2 through the supporting surface A of the casing supporting member 40. According to this embodiment, since the suction flange 14, the outlet flange 23 and the casing flange 2 are integrally connected to one another, the piping forces applied to the suction pipe and the outlet pipe are mainly transmitted to the casing flange 2 having high strength, thus preventing the pump casing from being deformed.

A connecting flange 29 of a suction pipe is connected to the suction flange 14. In connecting the connecting flange 29 with the suction flange 14, bolts 31 are inserted through bolt holes 14*a* (see FIG. 2) from outside of the connecting flange 29, and then the nuts 33 are engaged with the bolts 31 and fastened.

The nuts 33 are inserted into the clearance between the suction flange 14 and the end plate 7 as shown in FIG. 1. Since the standard (DIN 24255) provides that the length L (see FIG. 1) between the front surface of the suction flange 14 and the center line of the outlet port 25 should be a prescribed length, the space between the suction flange 14 and the end plate 7 cannot be provided at will. Therefore, the nuts 33 must be inserted into a narrow space.

However, since it is difficult to insert the nuts 33 into the narrow space between the suction flange 14 and the end plate 7, there are provided four free spaces 35 for assembling work in this pump casing. The free spaces 35 are formed at the positions into which the nuts 33 are inserted as shown in FIGS. 1 and 3, and are formed between the supporting member 19 and the adjacent supporting member 19.

Figure 6:
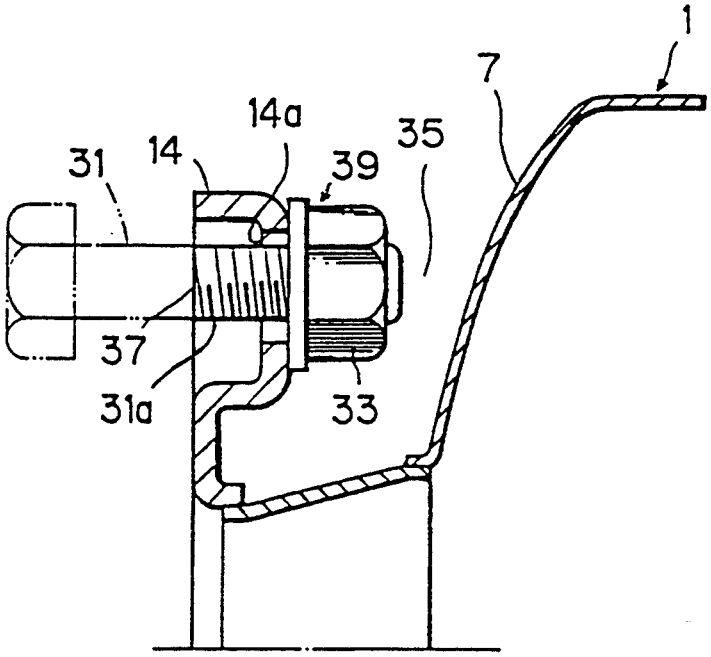
FIG. 6 is an explanatory cross-sectional view showing how an assembly member comprising a shaft portion and a nut is removed from the suction flange.
Figure 7:
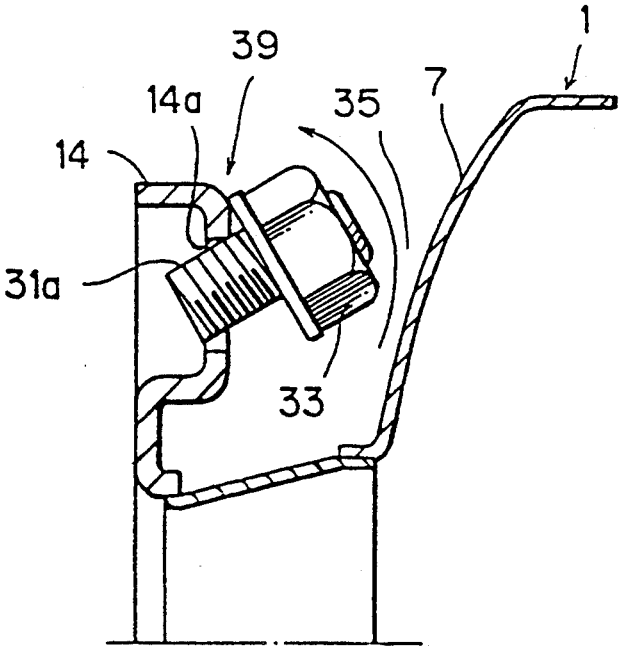
FIG. 7 is an explanatory cross-sectional view showing how an assembly member comprising a shaft portion and a nut is removed from the suction flange.

Further, in this kind of pump casing, when used for a long time, the bolts 31 and nuts 33 will corrode, and there is a possibility that the nuts 31 cannot be loosened. In this case, the shaft portion 31*a* of the bolts 31 is cut off along the cutting plane line 37 as shown in FIG. 6, the assembly member 39 comprising a shaft portion 31*a*, and a nut 33 is rotated in the free space 35 to remove it from the bolt hole 14*a* of the suction flange 14 as shown in FIG. 7. That is, the size of the free space 35 is formed so that the assembly member 39 including the shaft portion 31*a* and the nut 33 can be swung to remove it from the suction flange 14.

In accordance with the present invention, transmission of piping forces are performed in two ways, one of which is from the suction flange 14 to the casing flange 2 through the casing supporting member 40, the other of which is from the suction flange 14 to the end plate 7 through the supporting members 19 and further from the outer periphery of the inner casing 42 fixed to the end plate 7 to the cylindrical portion (liner ring member) 42*b* of the inner casing 42. Inasmuch as there is a clearance in an axial direction and no connection between the inner casing 42 and the suction nozzle 4, even if the suction nozzle 4 is deformed by external forces such as piping forces, deformation is not directly transmitted to the cylindrical portion (liner ring member) 42*b* of the inner casing 42, thus hardly causing deformation of the liner ring member.

Further, external forces such as piping forces are transmitted from the suction flange 14 to the part of the end plate 7 having high strength through the supporting members 19. Thus, the amount of deformation is small at the end plate 7. Besides, when deformation of the end plate 7 causes deformation of the cylindrical portion (liner ring member) 42*b* of the inner casing 42 positioned at the central portion of the pump, the amount of deformation is even further reduced.

Therefore, actual deformation at the cylindrical portion (liner ring member) 42*b* is extremely small.

In other words, because the inner casing 42 is fixed to the part of the end plate 7 which is far apart from the suction nozzle 4 and has high strength, the amount of deformation caused by external forces is extremely small at the position of the liner ring member. Thus, it is hardly possible that the liner ring 28 will contact the impeller 8.

In this embodiment, the liner ring 28 is provided in the cylindrical portion (liner ring member) 42*b* of the inner casing 42. However, it should be noted that the cylindrical portion (liner ring member) 42*b* functions as a liner ring without the liner ring 28.

As is apparent from the foregoing description, according to the first embodiment of the present invention. Since the projecting portion has a substantially semicircular cross section, the end plate has an arcuately curved surface, the base portion of the projecting portion is located on the extension of the arcuately curved surface of the end plate so as to provide continuity from the end plate to the projecting portion, there is no portion where a great deal of bending stress caused by stress concentration is generated, and the pump casing has a high rigidity and strength in its entirety. Even if excess external forces such as piping forces are applied to the suction flange, deformation of the liner ring portion can be prevented or can be reduced to a minimum, thereby preventing the liner ring portion from contacting the impeller because the external forces are transmitted to the end plate of the casing jacket having a rigid structure through the supporting member. Further, the liner ring portion is provided on the inner casing independently of the end plate or the suction nozzle so that the external forces are not directly transmitted to the liner ring portion, thus avoiding deformation of the liner ring portion.

Next, a second embodiment of a pump casing made of sheet metal according to the present invention will be described below with reference to FIGS. 9 through 12.

Figure 9:
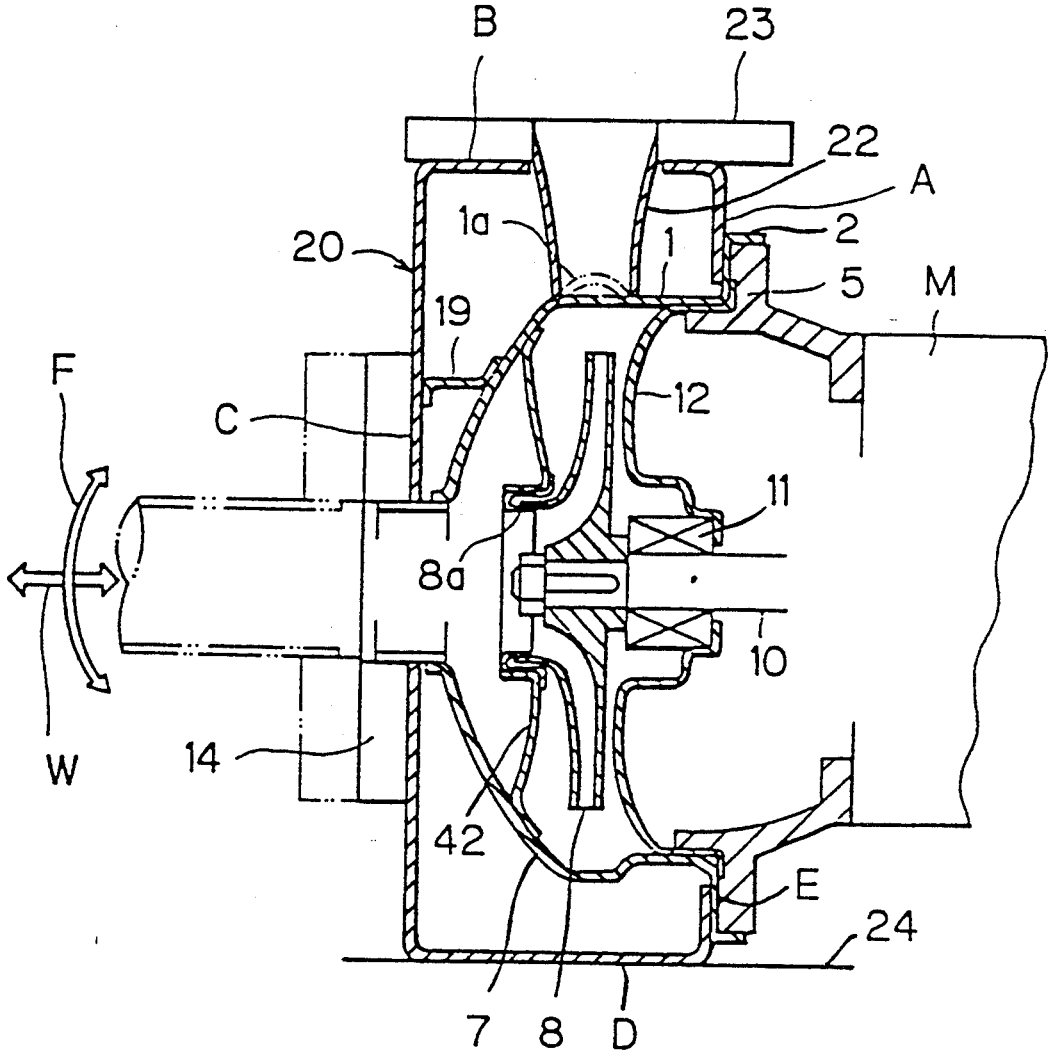
FIG. 9 is a cross-sectional view showing a pump casing made of sheet metal according to a second embodiment of the present invention.

FIG. 9 shows a pump casing made of sheet metal having a casing supporting member. Those parts shown in FIG. 9 which are structurally and functionally identical to or similar to those shown in FIG. 1 are denoted with identical reference numerals.

In FIG. 9, a casing jacket 1 is formed of sheet metal and manufactured by press work or bulging. The bulging is performed to form the casing jacket 1 by applying internal pressure to the casing jacket 1 using a medium for applying pressure such as liquid or rubber. The casing jacket 1 is provided with a suction nozzle 4 having one end to which a suction flange 14 is attached, and an outlet nozzle 22 having one end to which an outlet flange 23 is attached. The casing jacket 1 has an end plate 7 at a left side end thereof and a casing flange 2 at the opposite side of the end plate 7. A casing jacket cover 12 is attached to the casing flange 2 in such a manner that the outer periphery of the casing jacket cover 12 is engaged with the casing flange 2 and fixed to the casing flange 2.

Figure 10:
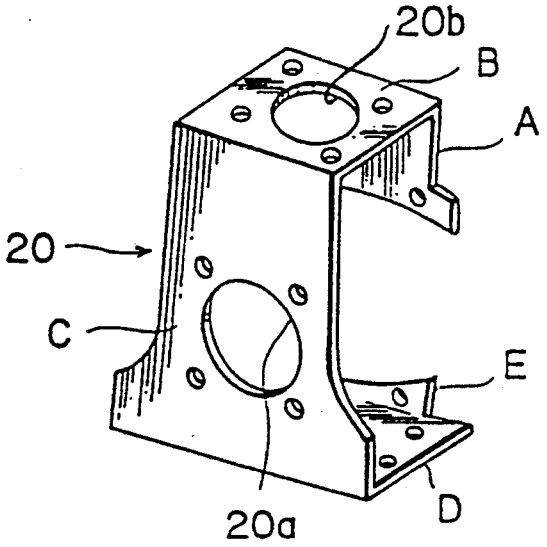
FIG. 10 is a perspective view showing a pump casing having a casing supporting member according to the second embodiment of the present invention.

Further, in this embodiment, as shown in FIG. 10, there is provided a casing supporting member 20 in the form of a channel and having four supporting surfaces. One of the four supporting surfaces (on the righthand side of FIG. 10) is cut away at the central portion thereof to thereby form two separated surfaces. That is, the casing supporting member 20 has three integral supporting surfaces B, C and D, and one remaining supporting surface comprising the separated surfaces A and E. The supporting surface C corresponding to the front surface (on the lefthand side of FIG. 10) is formed with an opening 20*a* through which the suction nozzle 4 passes, and the supporting surface B corresponding to the upper surface is formed with an opening 20*b* through which the outlet nozzle 22 passes. As shown in FIG. 9, the supporting surface C supports the suction flange 14 mounted thereon by welding or the like and the supporting surface B supports the outlet flange 23 mounted thereon. The surface A and the surface E, constituting one supporting surface but being spaced apart from each other in the same plane support the casing flange 2 mounted thereon. The casing flange 2 is mounted on a bracket 5 made of castings. The supporting surface D is fixed to the base 24. An impeller 8 is supported by a shaft 10 which is connected to a motor M. A shaft seal 11 is provided between the casing jacket cover 12 and the shaft 10 to seal off the clearance therebetween. Supporting members 19 are provided between the suction flange 14 and the end plate 7.

With the above structure, when the pump is in operation, the casing jacket 1 is prevented from being deformed due to the internal pressure caused by the pump per se. Further, external forces F such as piping forces which are applied to the suction pipe and the outlet pipe as bending moments and axial external forces W are borne by the casing supporting member 20, and one therefore, not transmitted to the casing jacket 1. Accordingly, the casing jacket 1 is prevented from being deformed. Since the casing supporting member 20 is mounted, at surfaces A and E thereof, on the casing flange 2 of the casing jacket 1 which has the highest strength in the casing jacket 1, and the casing flange 2 is mounted on the bracket 5 made of castings, these parts have an extremely high strength and rigidity. After the casing jacket 1 is mounted on the casing supporting member 20 at the surfaces A and E, the casing supporting member has an overall a box-like shape. Thus, the casing supporting member 20 becomes extremely rigid. The casing supporting member 20 having such rigidity is provided with the supporting surface B on which the outlet flange 23 is mounted, the supporting surface C on which the suction flange 14 is mounted, and the supporting surface D serving as a leg member for supporting the pump casing. Incidentally, in this embodiment, since the piping forces applied to the suction flange 14 are mainly transmitted to the base 24 through the casing supporting member 20, the supporting member 19 may be eliminated.

Figure 11:
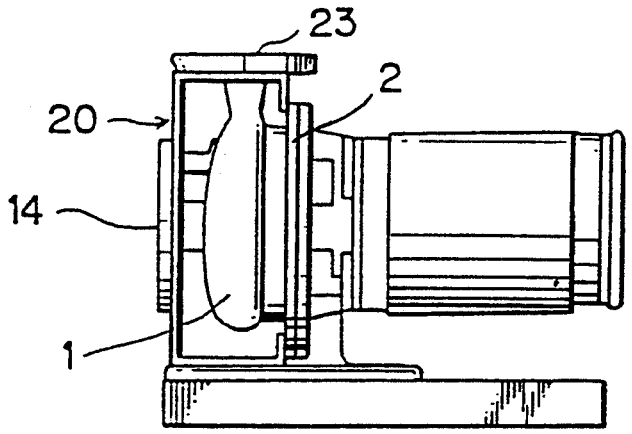
FIG. 11 is a side view showing a pump and motor unit which incorporates the pump casing according to the second embodiment of the present invention.
Figure 12:
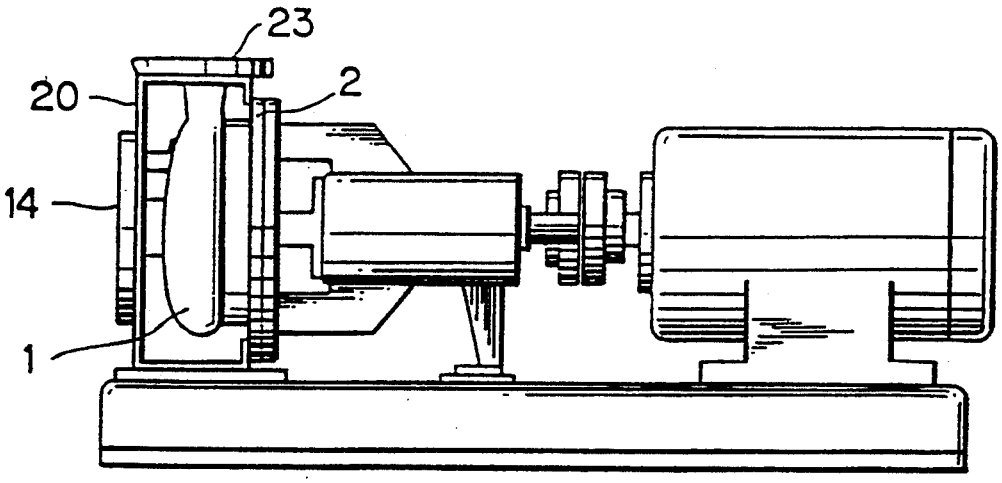
FIG. 12 is a side view showing a pump which directly couples a motor and incorporates a pump casing according to the second embodiment of the present invention.
Figure 13B:
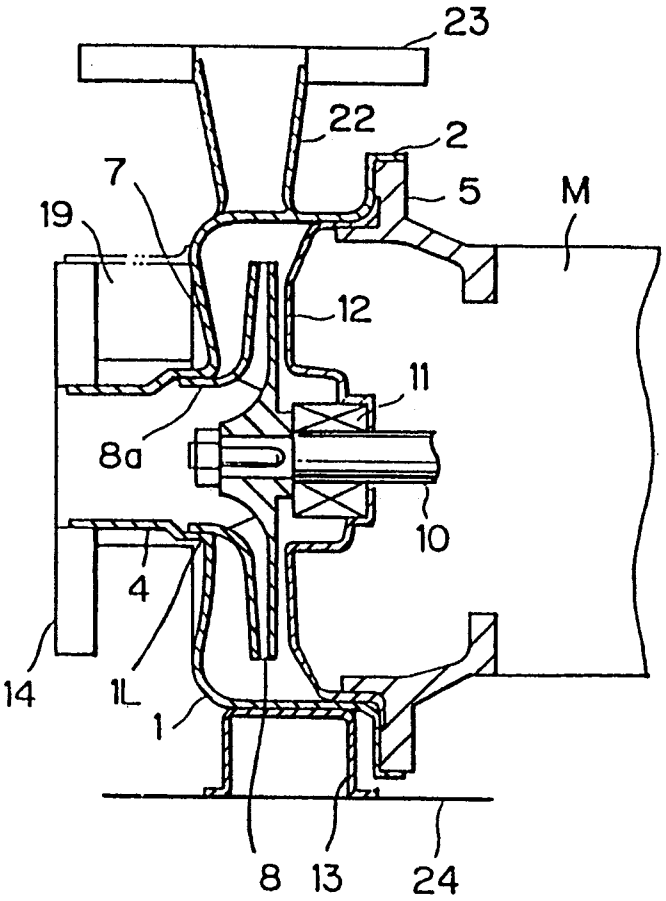
FIG. 13(b) PRIOR ART
FIGS. 13(*a*) and 13(*b*) show a conventional pump casing made of sheet metal, FIG. 13(*a*) is a front view showing the conventional pump casing, and FIG. 13(*b*) is a cross-sectional view showing the conventional pump casing.
Figure 13A:
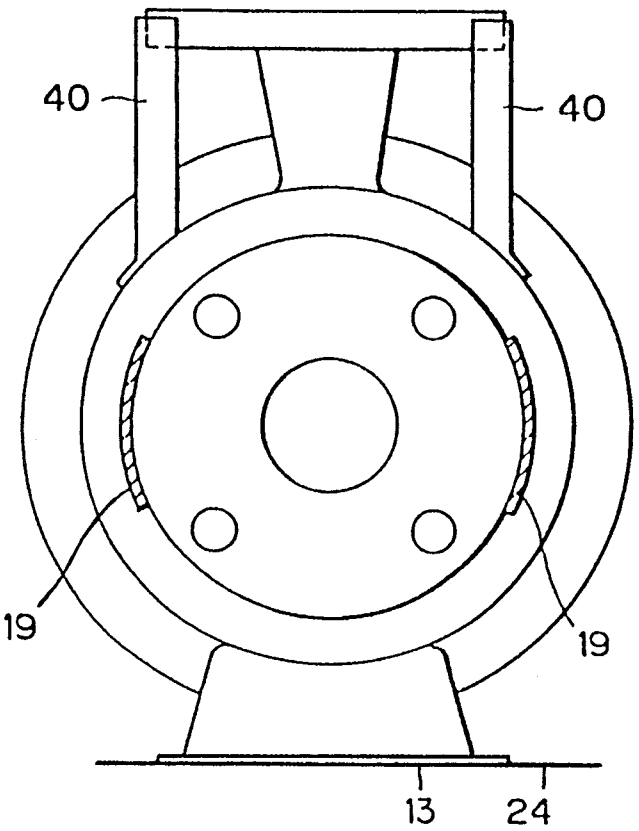
FIG. 13(a) PRIOR ART

FIG. 11 is a side view showing a usage example in which a pump and motor unit incorporates the pump casing according to the second embodiment of the present invention. FIG. 12 is a side view showing another usage example in which a pump couples a motor directly and incorporates the pump casing according to the second embodiment of the present invention.

In the second embodiment, the casing supporting member has been described as being formed by an integral member. However, it may be formed by assembling a plurality of separate members. The separate type of casing supporting member offers the advantages of easy welding and assembling.

Further, in the second embodiment, the casing supporting member has been described as a structure having at the bottom thereof the supporting surface D which is utilized as a leg member. However, in the pump casing which is supported by the adjacent member such as a motor, at least surfaces A, E, B and C are enough to support the pump casing. The surface D may be a bridge-like member.

The conventional pump casing made of sheet metal has necessitated three supporting members including a suction flange supporting member, an inlet flange supporting member and a leg member. However, according to the second embodiment of the present invention, since the casing supporting member can be constituted by a single integral member, the pump casing is simple in structure. Since the casing supporting member is not located at the place where liquid exists, it is possible to use low-priced carbon steel different from the pump casing which is generally made of stainless steel plate. Thus, the production cost of the pump casing can be reduced. The casing supporting member of the present invention is fixedly secured to the casing flange which is mounted to the bracket made of castings and has the highest strength in the pump casing, therefore, the rigidity of the pump casing is enhanced and a large supporting function is attainable. Further, according to the present invention, since piping forces caused by the suction pipe and the outlet pipe are transmitted to the casing supporting member, the piping forces are not transmitted to the casing jacket and the casing jacket is prevented from being deformed. The thickness of the casing jacket is determined only by the internal pressure caused by the pump per se. Since the casing supporting member prevents the pump casing from being deformed due to the internal pressure, it is possible to make the pump casing jacket thin to reduce the production cost.

Conventionally, a supporting member has been required between the suction flange and the casing jacket to prevent the deformation of the suction flange, however, according to the present invention, it is possible to use the connecting portion between the suction flange and the casing flange as a leg member for a pump. Such leg member is fixedly secured to the rigid base by bolts or the like, the casing supporting member per se may be further strengthened.

Although certain preferred embodiments have been shown and described, it should be understood that many changes and modifications may be made therein without departing from the scope of the appended claims.

What is claimed is:

1. A pump casing made of sheet metal, comprising:

a casing jacket having a cylindrical cup shape and including, at one end thereof, a casing flange, and, at the other end thereof, an end plate axially outwardly bulged to form an arcuately curved end surface; and wherein a radially outwardly bulged projecting portion projects radially outwardly from a radially outer periphery of said casing jacket in a volute shape, said projecting portion having first and second base portions connecting to said casing jacket and a radially outermost portion between said first and second base portions, said first base portion being formed as an extension of said arcuately curved end surface such that a major portion of said arcuately curved end surface, together with a first portion extending from said first base portion to said radially outermost portion of said projecting portion, constitute a continuous portion having no inflection points.

2. The pump casing made of sheet metal, according to claim 1, wherein said projecting portion includes a second portion extending from said radially outermost portion to said second base portion, said second portion being formed continuously with said first portion and having an inflection point only at said second base portion.

* * * * *